US005948003A

United States Patent [19]

Shefflin

[11] Patent Number: 5,948,003

[45] Date of Patent: Sep. 7, 1999

[54] PACIFIER CLIP AND COVER

[76] Inventor: Joanne Shefflin, 850 Highland Ave., Piedmont, Calif. 94611

[21] Appl. No.: 08/795,456

[22] Filed: Feb. 4, 1997

Related U.S. Application Data

[63] Continuation of application No. 08/611,692, Mar. 6, 1996, abandoned.

[51] Int. Cl.[6] ..... A61J 17/00

[52] U.S. Cl. ..... 606/234; 606/236

[58] Field of Search ..... 606/234–236, 606/151, 157; 267/53; D11/40; D28/39; 24/32, 35, 455, 499, 563, DIG. 13, DIG. 22

[56] References Cited

U.S. PATENT DOCUMENTS

D. 276,939 12/1984 Pascoe .
4,329,996 5/1982 Copeland .
4,417,613 11/1983 Ryan et al. ..... 606/234
4,765,037 8/1988 Perry .
4,946,054 8/1990 Maniero et al. .
4,990,157 2/1991 Roberts et al. ..... 606/234
5,156,617 10/1992 Reid ..... 606/236
5,318,191 6/1994 Pomales et al. .

*Primary Examiner*—Glenn K. Dawson
*Attorney, Agent, or Firm*—Lambach & Lambach L.L.P.

[57] ABSTRACT

A pacifier clip and cover combination includes an enlarged pinch clip and a ribbon. The pinch clip is movable between opened and closed positions and is large enough in the body of the clip as to fit over and fully cover the nipple portion of a standard pacifier and to therefore protect the nipple from contact with the surrounding environment and keep it clean during storage. The ribbon is attached between the clip and cover combination and a standard pacifier. Thus, during use, the clip is clipped to an infant's clothing to prevent the pacifier from falling to the ground.

12 Claims, 3 Drawing Sheets

PACIFIER CLIP AND COVER

This is a continuation of application Ser. No. 08/611,692 filed on Mar. 6, 1996, now abandoned.

BACKGROUND OF THE INVENTION

Currently available infant products include infant pacifiers, pacifier covers and pacifier clips. Pacifiers are most commonly sold with pacifier covers, the purpose of which is to keep pacifier nipples clean and protected from damage when not in use.

Pacifier covers are generally made from firm but somewhat flexible plastic material. Some pacifier covers fully surround the entire pacifier and include closures at one end. Another more common cover design has an open end molded to form fit over the pacifier mouth guard with a light resistance snap fit.

A problem with these existing covers is that they are not tethered in any way to the pacifier. Thus, they must be separated from the pacifier completely while the pacifier is in use. As a result, the covers are frequently lost and easily broken and thus difficult to find when it comes time to re-cover the pacifier. Thus there is reason for improvement in this regard.

The purpose of a pacifier clip is to prevent the pacifier from falling to the floor when the infant takes the pacifier out of his or her mouth. A typical pacifier clip generally consists of a pinch clip glued to the back of a piece of plastic which is large enough in width and length to pass the small parts test for products which may present choking hazards for children. A ribbon connects the pacifier clip to a pacifier, and the pacifier clip is attached to the infant's clothing at a location which will permit the pacifier to reach the infants mouth. In this manner, a pacifier clip prevents loss of the pacifier to which it is attached. Pacifier clips are frequently sold together with pacifiers, although they are also sold as separate items.

While pacifier clips are extremely useful, they serve only to clip the pacifier to the infant and they thus do not provide for the protection of the pacifier nipple during storage. Thus, there is a need for a single product that can achieve the functions of both the clip and the cover.

Accordingly, it is an object of this invention to provide an improved pacifier cover that can also be attached to an infant's clothing in the same manner as a pacifier clip, that is easily accessible so that it can be positioned over the nipple for protection during storage of the pacifier, and that may remain detachably connected to any standard pacifier at all times, including during use of the pacifier.

Another object of this invention is to provide a pacifier clip which can serve as a pacifier cover while the pacifier is not is use, and which, during use of the pacifier, can be attached to an infant or its clothing, for the purpose of preventing the pacifier from falling to the floor when the infant takes the pacifier out of its mouth and to prevent loss of the pacifier.

This invention is a single article which includes each of the above functions.

SUMMARY OF INVENTION

In view of the above, it would be desirable to have an improved device capable of performing pacifier clipping and covering functions and that is universally adapted to all standard pacifiers currently on the market. Specifically, it would be desirable to have a pacifier cover for keeping a pacifier nipple clean and protected during non-use of the pacifier and to have the same cover also be a clip that can be attached to an infants clothing to prevent the pacifier from falling on the floor where it can become lost or soiled.

Therefore, the pacifier clip and cover combination of the present invention comprises an enlarged pinch clip and a ribbon. The pinch clip is movable between opened and closed positions and is large enough in the body of the clip as to fit over the nipple portion of the standard pacifier in a full covering position. Side walls extend from the top and bottom walls of the clip and serve to fully surround the nipple when the clip and cover combination is in the closed position on the pacifier nipple. This protects the nipple from contact with the surrounding environment and keeps it clean when stored in this manner.

A ribbon is removably or permanently attached between the clip and cover combination and a standard pacifier. This allows the pacifier clip and cover combination and the pacifier to remain attached to one another substantially at all times. Preferably, the ribbon is detachable from the clip and cover combination and from the pacifier using a releasable mans such as velcro or a snap.

These and other objects, features, and advantages of the present invention will be more apparent from the following description and drawings.

DESCRIPTION OF THE PREFERRED EMBODIMENT

With reference to the drawings, the preferred embodiments of the present invention will be described. The pacifier clip and cover combination (also described herein using the term "clip and cover") is broadly denoted by the numeral 10 as shown in FIGS. 1–8.

FIGS. 1, 2, 3 and 8 illustrate the clip and cover 10 in use. The pacifier clip and cover 10 has two uses intended to keep the pacifier 14 clean, to prevent the pacifier from getting lost, and to prevent the pacifier cover itself from getting lost during use of the pacifier.

Figure 1:
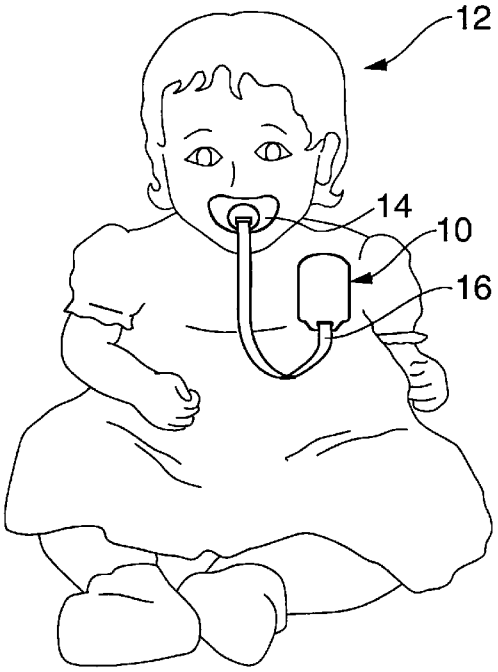
FIG. 1 is a perspective view of an embodiment of a pacifier clip and cover combination according to the present invention, shown attached to an infant.

FIG. 1 shows one use of the clip and cover 10, in which it is attached to an infant 12 and to a standard pacifier 14. When used in this manner, the clip and cover 10 prevents the pacifier from getting lost or dirty when it falls from the infant's mouth. It also prevents the clip itself from becoming lost so that it may be used to cover the pacifier nipple when the pacifier is not being used.

Figure 2:
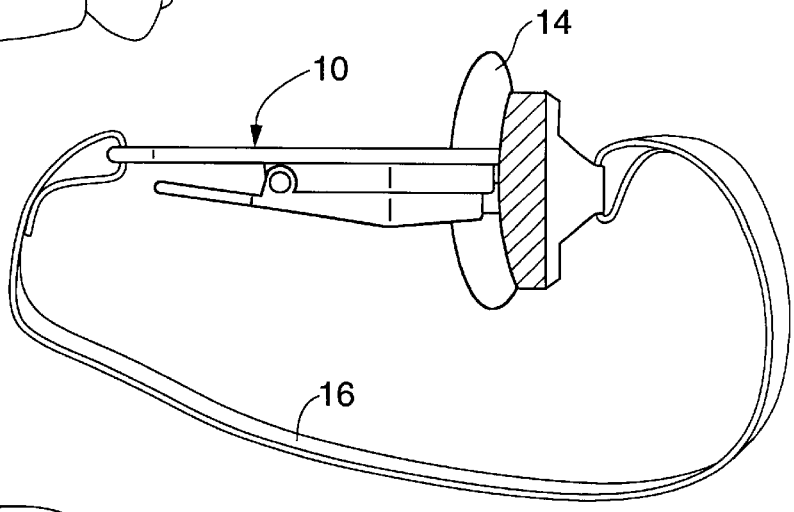
FIG. 2 is a side elevation view of the pacifier clip and cover combination of FIG. 1 in the covering position over the nipple portion of a standard pacifier with a portion of the pacifier shown in cross-section to show a full side view of the invention.
Figure 3:
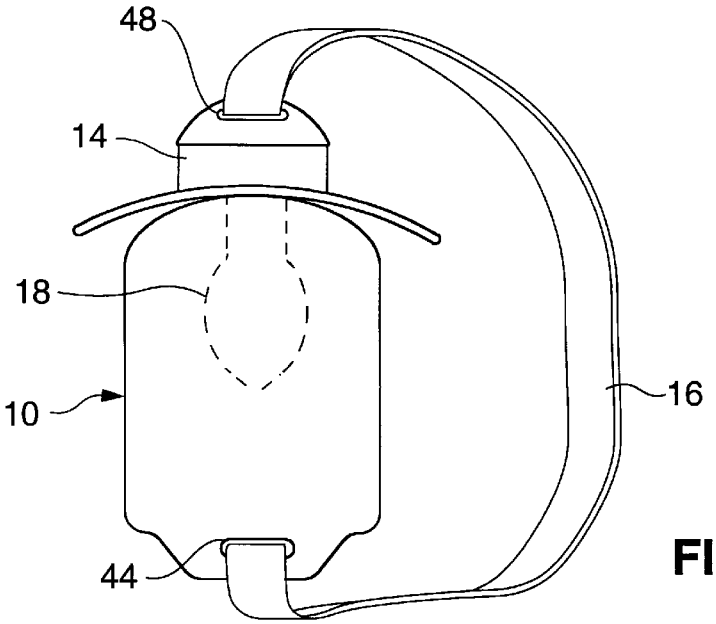
FIG. 3 is a plan view of the pacifier clip and cover combination of FIG. 1 covering the nipple portion of a standard pacifier. Broken lines indicate the location of the nipple inside the cover.
Figure 8:
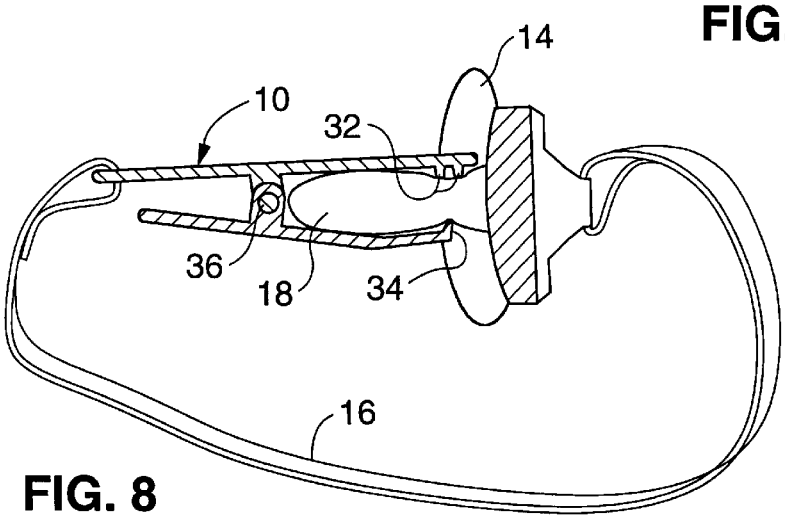
FIG. 8 is a cross-sectional side view of the pacifier clip and cover of FIG. 1 covering the nipple portion of a standard pacifier and including a ribbon attaching the clip and cover to a standard pacifier.

FIGS. 2, 3 and 8 show the second use of the pacifier clip and cover 10 in which it is in the closed position enclosing the nipple 18 (not visible in FIG. 2) on a standard pacifier 14. The clip and cover 10 is combined with the pacifier 14 in this manner when the pacifier is not in use in order to keep the nipple 18 clean.

Figure 9:
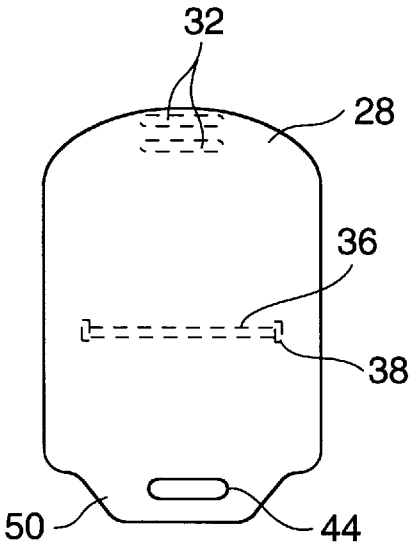
FIG. 9 is a top plan view of the pacifier clip and cover of FIG. 1.
Figure 10:
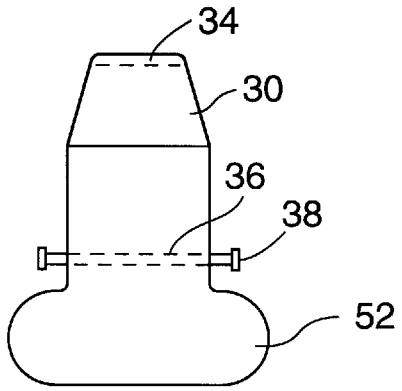
FIG. 10 is a bottom plan view of the pacifier clip and cover of FIG. 1.
Figure 11:
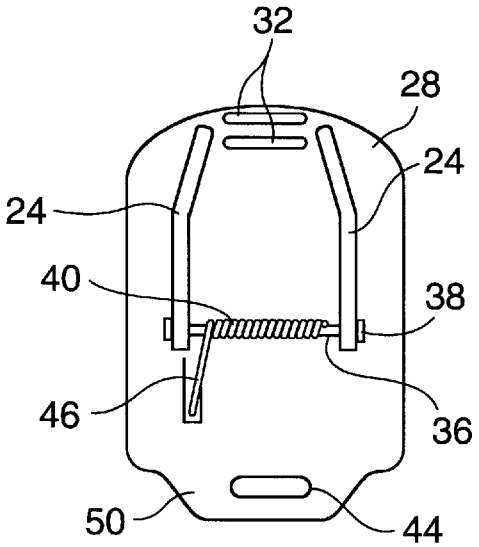
FIG. 11 is a plan view of the underside of the top component of the pacifier clip and cover of FIG. 1.
Figure 12:
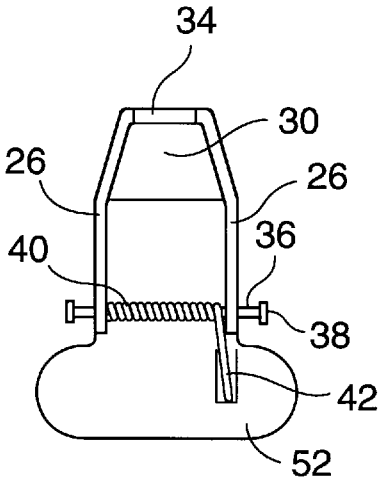
FIG. 12 is a plan view of the underside of the bottom component of the pacifier clip and cover of FIG. 1.

The pacifier clip and cover 10 is comprised of a top plate 28 (FIGS. 9 and 11) and a bottom plate 30 (FIGS. 10 and 12). Top plate 28 has a back portion 50 which includes a slot 44. Bottom plate 30 has a back portion 52 which may be slightly shorter in length than back portion 50 (see FIGS. 4–7).

Figure 4:
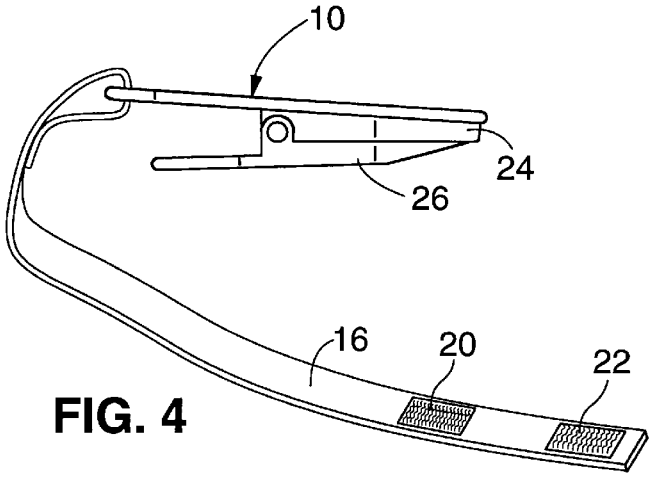
FIG. 4 is a side view of the pacifier clip and cover combination of FIG. 1 in the closed condition and including a ribbon and an optional velcro fastener for attaching the ribbon to a standard pacifier.
Figure 5:
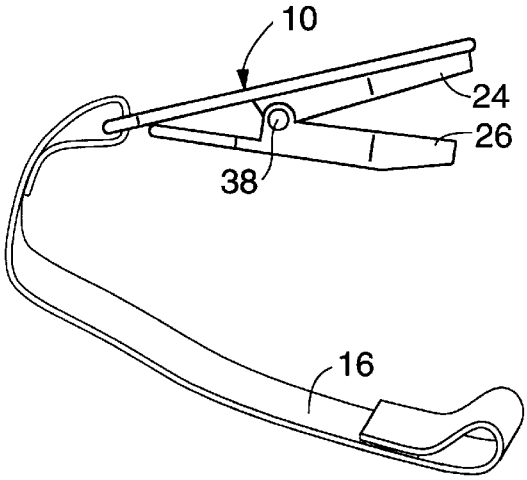
FIG. 5 is a side view of the pacifier clip and cover combination of FIG. 1 in the open position, with a ribbon attached thereto.
Figure 6:
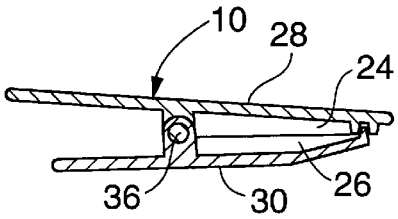
FIG. 6 is a cross-sectional side view of the pacifier clip and cover of FIG. 1 in the closed position.

Referring to FIGS. 2–5 and 8, a strap 16 is attached at one end to the pacifier clip and cover 10 and at the other end to the pacifier 14. One end of the strap 16 is threaded through slot 44 (FIG. 3) in rear portion 50 of top plate 28 and the other end of the strap is threaded through a slot 48 on the pacifier 14. The strap is inserted at one end through the slot 44 on the pacifier clip and cover combination 10 and secured back on itself by velcro fasteners 20, 22 as shown in FIGS. 4 and 5. It should be understood that alternative locations for connecting the strap 16 on the pacifier clip and cover 10 and/or the pacifier 14 are equally viable as are other means for securing the strap such as a snap or hook or sewing. It should also be appreciated that the term strap is used to denote any type of line, rope, ribbon, or other means by which the pacifier and clip may be tethered together.

Referring to FIGS. 4–7, 11 and 12, top side walls 24 extend downwardly from top plate 28, and bottom side walls extend upwardly from bottom plate 26. Since side walls 24, 26 are formed on both sides of the clip 10 (FIGS. 11 and 12), they form the covering portion of the pacifier clip and cover 10 that fits over, surrounds and protects the pacifier nipple 18.

Figure 7:
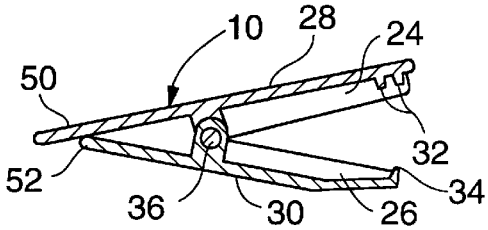
FIG. 7 is a cross-sectional side view of the pacifier clip and cover of FIG. 1 in the open position.

As best seen in FIG. 7 (in which the clip and cover 10 is shown in its opened condition), a pair of parallel front walls 32 extend downwardly from top plate 28, and a corresponding front wall extends upwardly from bottom plate 30. The front walls 32, 34 form a grip around the nipple 18 when the pacifier clip and cover 10 is in the closed position on the pacifier 14 as shown in FIG. 8, and they function together with the side walls 24, 26 to enclose the nipple 18 and protect it from becoming dirty.

The side walls 24, 26 are hinged together by a connector pin 36 which is secured in place by rivets 38. The connector pin 36 extends through holes in the upper side walls 24 and overlapping holes in lower side walls 26 (FIGS. 4–8) and thereby connects the top plate 28 to the bottom plate 30.

As shown in FIGS. 11 and 12, a spring 40 comprising a wire coil is wrapped around the pin 36. The spring 40 includes a straight extension portion 46 that presses against the underside of the top wall 28 and thus biases the pacifier clip and cover 10 in the closed position. The clip and cover 10 may be opened by pressing back portions 50, 52 of walls 28, 30, respectively, towards one other to overcome the biasing force of spring 40.

The pacifier clip and cover 10 thus provides an easy to use clip that (1) clips to the pacifier 14 in a closed, covering, position (FIG. 8) to keep clean and protect the nipple 18 and (2) with the same easy pinching motion clips to the clothing of the infant 12 (FIG. 1) to prevent loss of the pacifier 14. This allows for the cover to remain with the pacifier substantially at all times and prevents the child care giver from having to search for the pacifier cover when it is time to store the pacifier 14 following its use. Just as easily, when it is time for the infant 12 to use the pacifier 14 the clip and cover 10 can be removed from the pacifier 14 and then clipped to the infants' 12 clothing. Thus one simple function provides for two important uses.

It should be understood that while the forms of the invention herein shown and described constitute preferred embodiments of the invention, they are not intended to illustrate all forms thereof. It also should be understood that the words used are words of description rather than limitation, and various changes may be made without departing without departing from the spirit and scope of the invention disclosed.

What is claimed is:

1. A combination pacifier and pacifier cover clip assembly, the assembly adapted to be attached to an infant for keeping a pacifier nipple clean and for preventing separation and loss of the pacifier, the assembly comprising:

a pacifier;

a removable hinged pinch clip covering the pacifier nipple to keep it clean, the pinch clip having a top and a bottom hinged together to allow for pivotal movement of the top and bottom relative to one another between an opened and a closed position, the top and bottom being oriented to surround most of the pacifier nipple when the pacifier nipple is positioned between the top and bottom;

a spring contacting the top and the bottom to bias the top and bottom in the closed position; and a strap having a first end connected to the pinch clip and a second end connected to the pacifier.

2. The pacifier and cover clip assembly of claim 1 wherein the pinch clip is attachable to the infant's clothing when not covering the pacifier nipple.

3. A method for protecting a pacifier comprising the steps of:

providing a cinch clip having jaws adapted to receive a pacifier nipple, a strap connected to the pinch clip, and a pacifier having a nipple;

connecting the strap the pacifier;

attaching the jaws of the pinch clip to the clothing of an infant by enclosing a portion of the clothing between the jaws;

removing the pinch clip from the clothing; and clipping the jaws of the pinch clip over the pacifier nipple, when the pacifier is not in use, to enclose most of the pacifier nipple within the pinch clip between the jaws.

4. A pacifier and pacifier cover clip assembly, the assembly attachable to an infant's clothing for preventing loss of the pacifier and for keeping the pacifier nipple clean, comprising, in combination:

a pacifier having a nipple;

a removable pinch clip covering the nipple of the pacifier; and a flexible connector attached to the pacifier and to the pinch clip.

5. The combination pacifier and pacifier cover clip assembly of claim 8 wherein the pinch clip comprises:

a top having a front portion;

a bottom hinged to the top, the bottom having a front portion, the pinch clip moveable between an opened position in which the front portions of the top and bottom are spaced apart, and a closed position in which the front portions are closer together than when the pinch clip is in the opened position and in which the top and bottom define at least in part a substantially closed cavity sufficiently large enough to contain the pacifier nipple; and means for biasing the pinch clip in the closed position.

6. The assembly of claim 4 wherein:

the pinch clip includes hinged jaws;

the pacifier includes a mouthpiece adjacent the nipple;

the nipple has a base portion adjacent the mouthpiece and a tip spaced from the mouthpiece; and the hinged jaws contact the portion of the nipple extending between the base and the tip.

7. A pacifier and combination pacifier cover and clip attachable to an infant's clothing for preventing loss of the pacifier and for keeping the pacifier nipple clean, comprising, in combination:

a pacifier having a nipple;

a removable pinch clip covering the nipple of the pacifier, the clip comprising a top plate having a front portion, a plurality of first walls connected to the top plate;

a bottom plate hinged to the top plate, the bottom plate having a front portion and a plurality of second walls connected to the bottom plate, the clip moveable between an opened position in which the front portions of the top and bottom plates are spaced apart, and a closed position in which the front portions are closer together than when the clip is in the opened position and in which the top and bottom plates and first and second walls define at least in part a substantially closed cavity sufficiently large enough to contain the pacifier nipple;

means for biasing the clip in the closed position; and a flexible connector attached to the pacifier and to the clip.

8. The combination pacifier cover and clip of claim 7 wherein:

the plurality of first walls include a pair of first side walls extending from the top plate towards the bottom plate; and the plurality of second walls include a pair of second side walls extending from the bottom plate towards the top plate.

9. The combination pacifier cover and clip of claim 3 wherein:

the plurality of first walls further include a front wall extending between the first side walls; and the plurality of second walls further include a front wall extending between the second side walls.

10. A pacifier and pacifier cover assembly, the assembly attachable to an infant's clothing for preventing loss of the pacifier and for keeping the pacifier nipple clean, comprising, in combination:

a pacifier having a nipple and a mouthpiece, the mouthpiece having first and second faces, the nipple extending from the first face;

a removable pinch clip covering the nipple of the pacifier while leaving at least the second face of the mouthpiece exposed; and a flexible connector attached to the pacifier and to the clip, the flexible connector being connectable to the infant's clothing.

11. The assembly of claim 10 wherein the clip includes hinged jaws, wherein the pacifier nipple has a base portion adjacent the mouthpiece and a tip spaced from the mouthpiece, and wherein the hinged jaws contact the portion of the nipple extending between the base and the tip.

12. A pacifier and pacifier cover clip assembly, the assembly attachable to an infant's clothing for preventing loss of the pacifier and for keeping the pacifier nipple clean, comprising, in combination:

a pacifier having a nipple and a mouthpiece;

a removable pinch clip removably covering the nipple of the pacifier independently of the mouthpiece of the pacifier; and a flexible connector removably attached to the pacifier and to the pinch clip.

* * * * *